US010850146B2

(12) United States Patent
Lee

(10) Patent No.: US 10,850,146 B2
(45) Date of Patent: Dec. 1, 2020

(54) AUTOMATICALLY ACTIVATED INTELLIGENT FIRE EXTINGUISHER

(71) Applicant: Young Bok Lee, Suwon-si (KR)

(72) Inventor: Young Bok Lee, Suwon-si (KR)

( * ) Notice: Subject to any disclaimer, the term of this patent is extended or adjusted under 35 U.S.C. 154(b) by 0 days.

(21) Appl. No.: 16/310,647

(22) PCT Filed: Sep. 15, 2017

(86) PCT No.: PCT/KR2017/010115
§ 371 (c)(1),
(2) Date: Dec. 17, 2018

(87) PCT Pub. No.: WO2018/056646
PCT Pub. Date: Mar. 29, 2018

(65) Prior Publication Data

US 2019/0321668 A1 Oct. 24, 2019

(30) Foreign Application Priority Data

Sep. 20, 2016 (KR) ..... 10-2016-0120195

(51) Int. Cl.
*A62C 37/40* (2006.01)
*B05B 12/16* (2018.01)
*B05B 3/10* (2006.01)

(52) U.S. Cl.
CPC ..... *A62C 37/40* (2013.01); *B05B 3/1035* (2013.01); *B05B 12/16* (2018.02)

(58) Field of Classification Search
CPC ..... A62C 35/11; A62C 35/13; A62C 37/09; A62C 37/10; A62C 37/11; A62C 37/38; A62C 37/40; B05B 3/1035; B05B 12/16
See application file for complete search history.

(56) References Cited

U.S. PATENT DOCUMENTS 3,588,893 A * 6/1971 McCloskey ..... A62C 99/009 169/61
3,752,235 A * 8/1973 Witkowski ..... A62C 35/605 169/61

(Continued)

FOREIGN PATENT DOCUMENTS

JP H06-006853 B2 1/1994
JP H06-292737 A 10/1994

(Continued)

OTHER PUBLICATIONS

Search Report, dated Jan. 16, 2018, for International Application No. PCT/KR2017/010115.

(Continued)

*Primary Examiner* — Darren W Gorman
(74) *Attorney, Agent, or Firm* — LRK Patent Law Firm

(57) ABSTRACT

An automatically activated intelligent fire extinguisher includes: a plurality of direction temperature sensors provided to sense temperatures in a plurality of directions; a rotating motor for providing rotational force; a fire-extinguishing liquid ejecting nozzle installed to communicate with a fire-extinguishing liquid valve and to rotate by rotational force from the rotating motor; a fire-extinguishing liquid valve for adjusting a fire-extinguishing liquid introduced into the fire-extinguishing liquid ejecting nozzle; and a direction control portion for controlling rotation of the rotating motor according to information regarding temperatures in respective directions sensed by the direction temperature sensor.

11 Claims, 7 Drawing Sheets

(56) References Cited

U.S. PATENT DOCUMENTS

| | | | | | |
|---|---|---|---|---|---|
| 3,866,687 | A * | 2/1975 | Banner | A62C 35/605 169/61 |
| 4,671,362 | A * | 6/1987 | Odashima | A62C 37/00 169/26 |
| 4,821,805 | A * | 4/1989 | Saito | A62C 37/00 169/5 |
| 5,548,276 | A * | 8/1996 | Thomas | A62C 37/38 169/61 |
| 5,727,634 | A * | 3/1998 | Ishida | A62C 31/05 169/60 |
| 7,066,273 | B2 * | 6/2006 | Tan | A62C 37/40 169/23 |
| 8,448,715 | B2 * | 5/2013 | Munro | E03C 1/04 169/54 |
| 9,573,008 | B1 * | 2/2017 | Fletcher | A62C 37/11 |
| 2004/0163827 | A1 * | 8/2004 | Privalov | G08B 17/005 169/46 |
| 2015/0021054 | A1 * | 1/2015 | McNamara | A62C 37/40 169/46 |
| 2017/0319882 | A1 * | 11/2017 | Hart | A62C 31/28 |

FOREIGN PATENT DOCUMENTS

| | | | |
|---|---|---|---|
| KR | 10-0585501 | B1 | 6/2006 |
| KR | 10-0935448 | B1 | 1/2010 |
| KR | 10-1553775 | B1 | 9/2015 |
| KR | 10-2016-0014752 | A | 2/2016 |
| KR | 10-2016-0090085 | A | 7/2016 |

OTHER PUBLICATIONS

Written Opinion, dated Jan. 16, 2018, for International Application No. PCT/KR2017/010115.

* cited by examiner

AUTOMATICALLY ACTIVATED INTELLIGENT FIRE EXTINGUISHER

CROSS-REFERENCE TO RELATED APPLICATIONS

The present application is a U.S. National Phase entry from International Application No. PCT/KR2017/010115, filed Sep. 15, 2017, which claims priority to Korean Patent Application No. 10-2016-0120195, filed Sep. 20, 2016, the disclosure of which is incorporated by reference herein in its entirety.

BACKGROUND

1. Technical Field

The present invention relates to an automatically activated intelligent fire extinguisher, and more particularly, to an automatically activated intelligent fire extinguisher configured to automatically discharge a fire-extinguishing agent in the direction of a fire in order to efficiently extinguish the fire.

In addition, the present invention relates to an automatically activated intelligent fire extinguisher having a convenient additional function, in addition to a fire-extinguishing activation function, so as to be used for purposes other than a fire-extinguishing purpose at ordinary times.

2. Description of Related Art

In general, fire extinguishers may be categorized as movable fire extinguishers and fixed fire extinguishers.

A mobile fire extinguisher is a fire extinguisher that can be moved, such as a powder fire extinguisher equipped in a house or an office. However, the mobile fire extinguisher must be directly manipulated by a person to operate and thus has a problem in that the mobile fire extinguisher cannot function at all when no person is present in a place in which a fire occurs.

A fixed fire extinguisher is a fire extinguisher fixed in a specific place, such as a sprinkler disposed on the ceiling. However, the fixed fire extinguisher discharges a fire extinguishing agent in random directions or to a previously-fixed target or range. Accordingly, when a fire has occurred in an unspecified direction, the fixed fire extinguisher may not discharge a sufficient amount of fire extinguishing agent in the direction of the fire, which is problematic.

In addition, a fire extinguisher of the related art is not provided with an alarm operating in the event of fire. Accordingly, a separate alarm must be provided in a place in which the fire extinguisher of the related art is equipped. That is, the fire extinguisher of the related art has an inefficiency problem in that a fire-detecting device and an alarm device must be provided separately. In addition, when the fire-detecting device and the alarm device are actuated by an external power source, none of such devices can operate in the event of power failure, which is problematic.

In particular, although a large cost is required to dispose a fire detecting device, an alarm device, and a fire extinguisher, such devices are useless at ordinary times, except for the event of fire.

RELATED ART DOCUMENT

KR 10-2016-0014752 A

SUMMARY

Accordingly, the present invention has been made keeping in mind the above problems occurring in the prior art, and an object of the present invention is to provide an automatically activated intelligent fire extinguisher configured to automatically discharge a fire-extinguishing agent in the direction of a fire and continuously track the propagation direction of the fire in order to efficiently extinguish the fire.

An object of the present invention is to provide an automatically activated intelligent fire extinguisher configured to generate various types of warning signals at a time of high probability of fire occurrence or in the event of fire, so that people can take quick actions.

An object of the present invention is to provide an automatically activated intelligent fire extinguisher configured to use a battery provided therein in the event of power failure and minimize the use of battery at ordinary times, thereby prolonging the lifetime of the battery.

An object of the present invention is to provide an automatically activated intelligent fire extinguisher provided with additional convenience features so as to be usable for purposes other than a fire-extinguishing purpose at ordinary times.

In order to accomplish the above object, according to an aspect of the present invention, an automatically activated intelligent fire extinguisher includes (1) a plurality of directional temperature sensors provided to detect temperatures in a plurality of directions, (2) a rotary motor providing torque, (3) a fire-extinguishing agent nozzle configured to be rotated by the torque of the rotary motor, (4) a fire-extinguishing agent valve communicating with the fire-extinguishing agent nozzle to adjust a fire-extinguishing agent input to the fire-extinguishing agent nozzle, (5) a direction controller controlling rotation of the rotary motor on the basis of information regarding the temperatures in the plurality of directions detected by the plurality of directional temperature sensors, (6) a control temperature sensor detecting a surrounding temperature, and (7) an operation controller controlling operations of the direction controller and the fire-extinguishing agent valve to be on only when information regarding the surrounding temperature detected by the control temperature sensor is a predetermined temperature or higher The direction controller may derive a highest temperature direction by comparing information regarding the temperatures in the plurality of directions detected by the directional temperature sensors for every predetermined time, and control rotation of the rotary motor so that the fire-extinguishing agent nozzle is oriented in the derived highest temperature direction.

The directional temperature sensors may be preferably disposed at equal angles.

The fire-extinguishing agent nozzle may be disposed to be replaceable depending on the angle of discharge and the type of the fire-extinguishing agent.

The automatically activated intelligent fire extinguisher according to an embodiment of the present invention may further include an alarm generating a warning signal.

The operation controller may control an operation of the alarm to be on and the operation of the direction controller to be on only when the information regarding the surrounding temperature detected by the control temperature sensor is the predetermined temperature or higher.

The operation controller may perform a control operation by dividing the information regarding the surrounding temperature detected by the control temperature sensor into a plurality of ranges. The operation controller may control (1) operations of the alarm, the direction controller, and the fire-extinguishing agent valve to be off when the information regarding the surrounding temperature detected by the control temperature sensor is in a first range, (2) the operation of the alarm to be on when the information regarding the surrounding temperature detected by the control temperature sensor is in a second range higher than the first range, and (3) the operations of the direction controller and the fire-extinguishing agent valve to be on when the information regarding the surrounding temperature detected by the control temperature sensor is in a third range higher than the second range.

The operation controller may control the operation of the direction controller, as well as the operation of the alarm, to be on when the information regarding the surrounding temperature detected by the control temperature sensor is in the second range.

The automatically activated intelligent fire extinguisher according to an embodiment of the present invention may further include: a battery supplying power; a first switch switching connection of the power of the battery supplied to the alarm; a second switch switching connection of the power of the battery supplied to the plurality of directional temperature sensors, the rotary motor, and the direction controller, and a third switch switching connection of the power of the battery supplied to the fire-extinguishing agent valve.

The operation controller may on/off control the first switch, the second switch, and the third switch depending on the information regarding the surrounding temperature detected by the control temperature sensor.

The operation controller may control (1) the first to third switches to be off when the information regarding the temperature detected by the control temperature sensor is in a first range, (2) the first and second switches to be on when the information regarding the temperature detected by the control temperature sensor is in a second range higher than the first range, and (3) the second and third switches to be on when the information regarding the temperature detected by the control temperature sensor is in a third range higher than the second range.

The automatically activated intelligent fire extinguisher according to an embodiment of the present invention may further include a heat insulator housing the rotary motor, the fire-extinguishing agent valve, the direction controller, the operation controller, and the battery, the heat insulator being an insulating member.

The automatically activated intelligent fire extinguisher according to an embodiment of the present invention may further include (1) an additional alarm sensor connector connectable to an additional alarm sensor, (2) an external power connector connectable to an external power source, and (3) an additional convenience feature connector connectable to an additional convenience feature except for a fire-extinguishing purpose.

The alarm may generate different types of warning signals depending on types of the additional alarm sensor connected to the additional alarm sensor connector.

According to another aspect of the present invention, an automatically activated intelligent fire extinguisher includes (1) a plurality of directional temperature sensors provided to detect temperatures in a plurality of directions, a rotary motor providing torque, (2) a fire-extinguishing agent nozzle configured to be rotated by the torque of the rotary motor, (3) a fire-extinguishing agent valve communicating with the fire-extinguishing agent nozzle to adjust a fire-extinguishing agent input to the fire-extinguishing agent nozzle, (4) a direction controller controlling rotation of the rotary motor on the basis of information regarding the temperatures in the plurality of directions detected by the plurality of directional temperature sensors, (5) a control temperature sensor detecting a temperature, an alarm generating a warning signal, and (6) an operation controller controlling an operation of at least one of the alarm, the direction controller, and the fire-extinguishing agent valve depending on information regarding the temperature detected by the control temperature sensor.

The operation controller may perform a control operation by dividing the information regarding the temperature detected by the control temperature sensor into a plurality of ranges. The operation controller may control (1) operations of the alarm, the direction controller, and the fire-extinguishing agent valve to be off when the information regarding the temperature detected by the control temperature sensor is in a first range, (2) the operation of the alarm to be on when the information regarding the temperature detected by the control temperature sensor is in a second range higher than the first range, and (3) the operations of the direction controller and the fire-extinguishing agent valve to be on when the information regarding the temperature detected by the control temperature sensor is in a third range higher than the second range.

Advantageous Effects

The automatically activated intelligent fire extinguisher according to an embodiment of the present invention configured as described above can automatically discharge a fire-extinguishing agent in the direction of a fire and continuously track the propagation direction of the fire in order to efficiently extinguish the fire.

The automatically activated intelligent fire extinguisher according to an embodiment of the present invention can generate a warning signal at a time of high probability of fire occurrence or in the event of fire, so that people can take quick actions.

The automatically activated intelligent fire extinguisher according to an embodiment of the present invention can use the battery provided therein in the event of power failure while using an external power source at ordinary times in order to minimize the use of the battery, so that the battery can be used for an extended time.

The automatically activated intelligent fire extinguisher according to an embodiment of the present invention can use additional alarm sensors depending on the characteristic of a place in which the fire extinguisher is disposed and generate different types of warning signals depending on the sensors, so that actions can be efficiently taken depending on types of fire.

The automatically activated intelligent fire extinguisher according to an embodiment of the present invention can perform additional convenience functions so as to be used for purposes other than a fire-extinguishing purpose at ordinary times.

The automatically activated intelligent fire extinguisher according to an embodiment of the present invention allows the entirety of various functions, such as power saving, alarm, fire detection, and fire-extinguishing, to be performed by a single device.

In the automatically activated intelligent fire extinguisher according to an embodiment of the present invention, the components essential for performance of a fire-extinguishing activation function are housed in a separate heat insulator, so that the length of time in which the fire-extinguishing activation function is performed can be extended even in a high-temperature environment in a fire.

DESCRIPTION OF THE REFERENCE NUMERALS IN THE DRAWINGS

Figure 1:
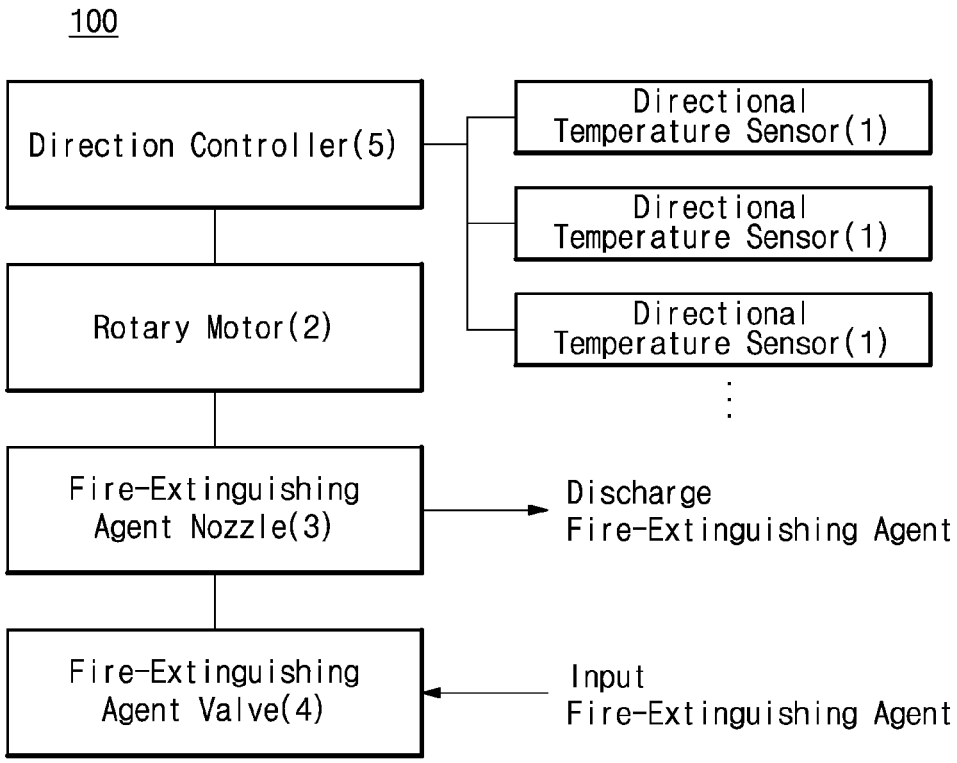
FIG. 1 is a configuration block diagram illustrating an automatically activated intelligent fire extinguisher 100 according to an embodiment of the present invention.

1: directional temperature sensor, 2: rotary motor
3: fire-extinguishing agent nozzle; 4: fire-extinguishing agent valve
5: direction controller, 6: control temperature sensor
7: alarm; 8: operation controller
9: battery; 10: first switch
11: second switch; 12: third switch
13: heat insulator; 14: additional alarm sensor connector
15: external power connector, 16: additional convenience feature connector
100: automatically activated intelligent fire extinguisher

DETAILED DESCRIPTION OF THE INVENTION

The above and other advantages and features of the present invention, as well as a method of realizing the same, will be more apparent with reference to following embodiments that will be described in detail in conjunction with the accompanying drawings. However, the present invention is not limited to the embodiments to be disclosed hereinafter and may be embodied in a variety of other forms. The embodiments set forth herein are provided for illustrative purposes to fully convey the concept of the present disclosure to those skilled in the art and is only defined by the Claims. Throughout this document, the same reference numerals and symbols will be used to designate the same or like components.

Terms used herein shall be interpreted as being illustrative, while not being limitative, of the embodiments. Descriptions of components in the singular form used herein are intended to include descriptions of components in the plural form, unless explicitly described to the contrary. It will be understood that terms, such as "comprise" and any variations thereof, when used herein, specify the presence of stated components, steps, operations, and/or elements but do not preclude the presence or addition of one or more other components, steps, operations, and/or elements. Unless otherwise specified, all terms (including technical and scientific terms) used herein have the same meaning as commonly understood by those skilled in the art to which this disclosure belongs. In addition, terms, such as those defined in commonly used dictionaries, should not be interpreted in an idealized or overly formal sense unless expressly so defined herein.

Hereinafter, embodiments of the present invention will be described in detail with reference to the accompanying drawings.

Figure 2:
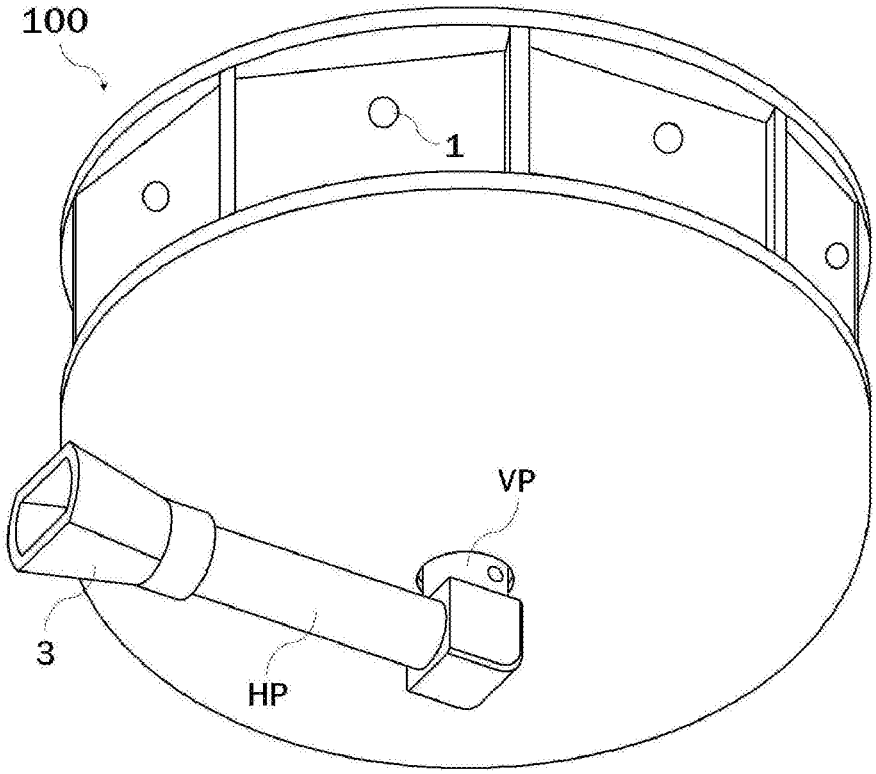
FIG. 2 is a top perspective view illustrating the automatically activated intelligent fire extinguisher 100 according to an embodiment of the present invention.
Figure 3:
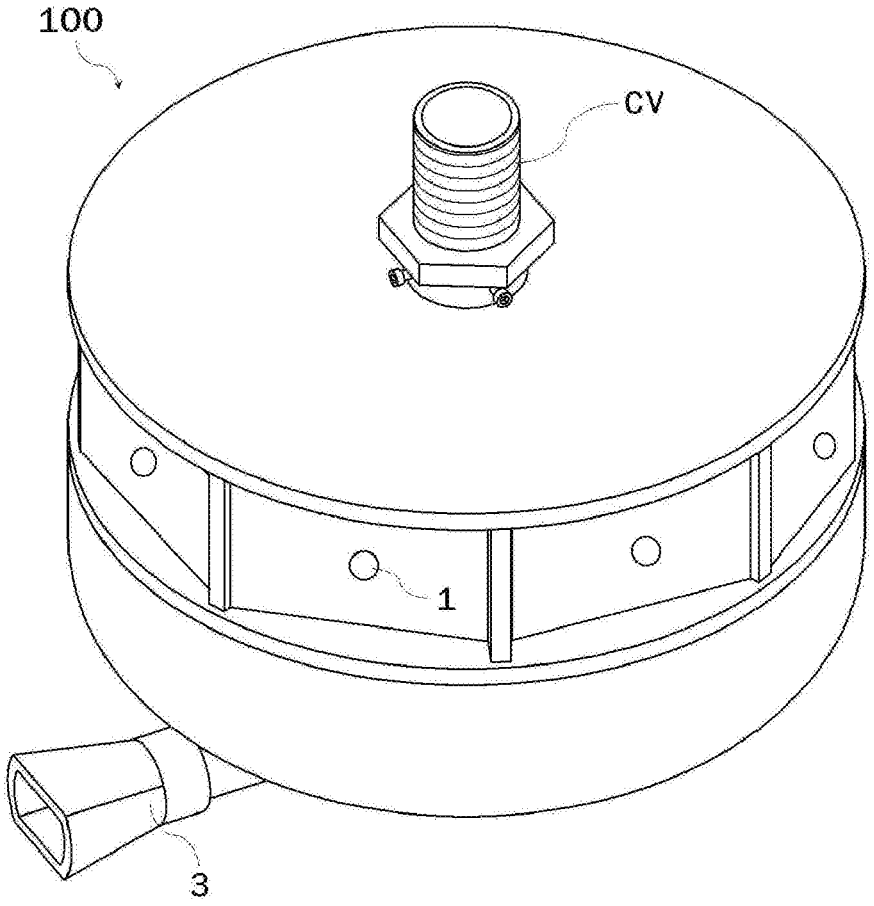
FIG. 3 is a bottom perspective view illustrating the automatically activated intelligent fire extinguisher 100 according to an embodiment of the present invention.

FIG. 1 is a configuration block diagram illustrating an automatically activated intelligent fire extinguisher 100 according to an embodiment of the present invention, FIG. 2 is a top perspective view illustrating the automatically activated intelligent fire extinguisher 100 according to an embodiment of the present invention, and FIG. 3 is a bottom perspective view illustrating the automatically activated intelligent fire extinguisher 100 according to an embodiment of the present invention.

As illustrated in FIG. 1, the automatically activated intelligent fire extinguisher 100 according to an embodiment of the present invention includes directional temperature sensors 1, a rotary motor 2, a fire-extinguishing agent nozzle 3, a fire-extinguishing agent valve 4, and a direction controller 5, to automatically discharge a fire-extinguishing agent in the direction of a fire in the event of fire.

The directional temperature sensors 1 are configured to detect temperatures and transfer temperature information to the direction controller 5. A plurality of such directional temperature sensors 1 is provided. When the direction controller 5 is activated, the directional temperature sensors 1 may be activated using a supply voltage supplied thereto under the control of the direction controller 5.

Here, the directional temperature sensors 1 are disposed in positions spaced apart from each other to face in different directions, such that the directional temperature sensors 1 can detect temperature information in respective directions. Accordingly, the direction controller 5 can analyze temperature information in a direction detected by each of the directional temperature sensors 1, and can advantageously derive and use information regarding the direction of a highest temperature (hereinafter, referred to as "highest temperature direction"), i.e. information regarding the direction of a fire or information regarding the direction of a strongest portion among a plurality of portions of the fire. That is, the direction controller 5 activates a fire-extinguishing activation function, so that a fire-directed fire-extinguishing operation and a fire-extinguishing operation based on tracking of a fire propagation direction can be performed. Hereinafter, information derived by the direction controller 5 as described above will be referred to as "highest temperature direction information."

For example, the directional temperature sensors 1 may be implemented as one of, but not limited to, a thermocouple temperature sensor, a resistance temperature detector (RTD) temperature sensor, a thermistor temperature sensor, an integrated circuit (IC) temperature sensor, a magnetic temperature sensor, a thermopile temperature sensor, and a pyroelectric temperature sensor.

As illustrated in FIGS. 2 and 3, the directional temperature sensors 1 may be preferably disposed at equal angles such that the direction controller 5 can more easily analyze the highest temperature direction information. For example, each of the directional temperature sensors 1 may be disposed at every 45°, such that a total of eight (8) directional temperature sensors 1 are provided. However, the present disclosure is not limited thereto. In addition, the directional temperature sensors 1 may be preferably implemented as the same type of temperature sensors having the same performance, such that the direction controller 5 can more accurately analyze the highest temperature direction information.

The rotary motor 2 is configured to provide torque to rotate the fire-extinguishing agent nozzle 3. In this case, when the direction controller 5 is activated, the rotary motor 2 may operate using a supply voltage supplied thereto under the control of the direction controller 5.

For example, the rotary motor 2 may be implemented as one of, but not limited to, a direct current (DC) rotary motor, a brushless rotary motor, a stepping rotary motor, a servo rotary motor, a coreless rotary motor, a vibration rotary motor, a universal rotary motor, and a geared rotary motor.

The fire-extinguishing agent nozzle 3 is configured to outwardly discharge the fire-extinguishing agent introduced thereto when the fire-extinguishing agent valve 4 is opened. The fire-extinguishing agent nozzle 3 is configured such that the fire-extinguishing agent nozzle 3 communicates with the fire-extinguishing agent valve 4 and is rotated by the rotary motor 2. The fire-extinguishing agent nozzle 3 is configured to be replaceable (attachable and detachable) depending on the angle of discharge and the type of the fire-extinguishing agent. Here, the fire-extinguishing agent nozzle 3 provided as above may have different discharge angles depending on the type of the fire-extinguishing agent.

For example, as illustrated in FIGS. 2 and 3, the discharge angles of the fire-extinguishing agent nozzle 3, at which the fire-extinguishing agent is discharged, may be set depending on the type of the fire-extinguishing agent and the number of the directional temperature sensors 1. Here, the fire-extinguishing agent nozzle 3 may be connected to a horizontal pipe HP, the horizontal pipe HP may be connected to a vertical pipe VP extending through the automatically activated intelligent fire extinguisher 100, and the vertical pipe VP may be rotatably connected to the fire-extinguishing agent valve 4 and to a connector CV. In addition, the vertical pipe HP may be connected to a following gear (not shown), and the following gear may be connected to the rotary motor 2 by gear engagement. Accordingly, the following gear is driven by rotation of the rotary motor 2, and the following gear driven as above enables the vertical pipe VP, the horizontal pipe HP, and the fire-extinguishing agent nozzle 3 to sequentially rotate. Here, the connector CV may be connected to the fire-extinguishing agent valve 4, and be connected to a fire-extinguishing instrument (e.g. a hydrant device, a movable fire extinguisher, or the like) by screw coupling or the like to be supplied with the fire-extinguishing agent therefrom.

The fire-extinguishing agent valve 4 is configured to adjust the fire-extinguishing agent input to the fire-extinguishing agent nozzle 3. The fire-extinguishing agent valve 4 may be connected to a pipe (e.g. the vertical pipe VP or the horizontal pipe HP) or the connector CV to which the fire-extinguishing agent is input. Here, when the fire-extinguishing agent valve 4 is opened, the fire-extinguishing agent is input. When the fire-extinguishing agent valve 4 is closed, the input of the fire-extinguishing agent is stopped.

In particular, the fire-extinguishing agent valve 4 may be implemented as an electric valve performing an opening or closing operation in response to an electrical signal or a mechanical valve performing an opening or closing operation by being actuated by a motor. In this case, the signal for activating the fire-extinguishing agent valve 4 may be preferably controlled by an operation controller 40. The operation controller 40 will be described in detail later.

The direction controller 5 is configured to control the rotation of the rotary motor 2 according to pieces of temperature information in respective directions detected by the directional temperature sensors 1. That is, the direction controller 5 compares the pieces of temperature information in the respective directions detected by the directional temperature sensors 1, and on the basis of the comparison result, controls the rotation of the rotary motor 2. Here, the direction controller 5 may control the rotation of the rotary motor 2 by applying a signal to the rotary motor 2.

For example, the direction controller 5 may derive the highest temperature direction information by comparing the pieces of temperature information in the respective directions detected by the directional temperature sensors 1, and control the rotation of the rotary motor 2 so that the fire-extinguishing agent nozzle 3 is oriented in the derived highest temperature direction. In this case, the automatically activated intelligent fire extinguisher 100 according to an embodiment of the present invention is advantageous in that the fire-extinguishing agent can be automatically discharged in the direction of a fire.

In particular, the direction controller 5 may derive the highest temperature direction information at every predetermined point in time. Accordingly, the direction controller 5 may control the rotation of the rotary motor 2 such that the fire-extinguishing agent nozzle 3 is oriented in the highest temperature direction at every predetermined point in time. In this case, the automatically activated intelligent fire extinguisher 100 according to an embodiment of the present invention can automatically discharge the fire-extinguishing agent while continuously rotating in the direction of a strongest portion among a plurality of portions of the fire, thereby more efficiently extinguishing the fire. For example, the direction controller 5 may derive the highest temperature direction information at every ten (10), thirty (30), or sixty (60) seconds, and the periodic point in time may be set and changed as required.

Figure 4:
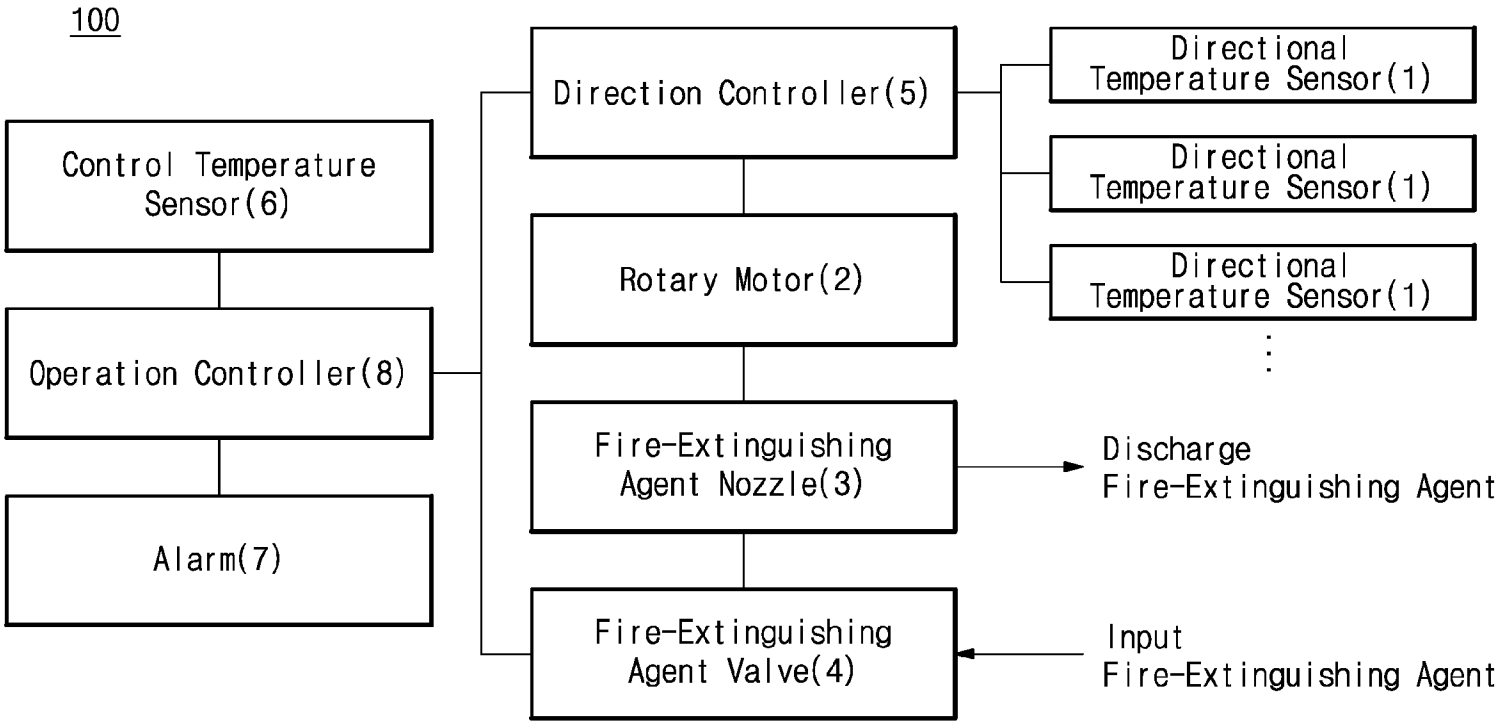
FIG. 4 is a configuration block diagram illustrating the automatically activated intelligent fire extinguisher 100 according to an embodiment of the present invention further including a second control sensor 20, an alarm 30, and an operation controller 40.

FIG. 4 is a configuration block diagram illustrating the automatically activated intelligent fire extinguisher 100 according to an embodiment of the present invention further including a control temperature sensor 6, an alarm 7, and an operation controller 8.

The automatically activated intelligent fire extinguisher 100 according to an embodiment of the present invention may further include the control temperature sensor 6, the alarm 7, and the operation controller 8.

The control temperature sensor 6 is configured to detect a surrounding temperature and transfer temperature information to the operation controller 8. That is, the directional temperature sensors 1 are temperature information providing devices provided to allow the direction controller 5 to derive the highest temperature direction information in the event of fire. In contrast, the control temperature sensor 6 is a device providing information regarding a surrounding situation, i.e. information regarding a surrounding temperature, to the operation controller 8, such that the operation controller 8 can determine a current surrounding situation (i.e. an ordinary time, a time having high probability of fire occurrence, an event of fire, or the like) and perform a control operation (i.e. a power saving function, an alarm function, a fire-extinguishing preparation function, a fire detecting function, a fire-extinguishing activation function, or the like) depending on the determined situation. In particular, since "the directional temperature sensors 1 and the direction controller 5" and "the control temperature sensor 6 and the operation controller 8" are separately provided, the automatically activated intelligent fire extinguisher 100 according to an embodiment of the present invention can reduce the amount of power consumed. This feature will be described in detail later.

In addition, the control temperature sensor 6 may preferably be implemented as a temperature sensor having superior performance (e.g. a wider detection temperature range, a higher response rate, a lower error range, higher detection accuracy, and the like) exceeding the performance of the directional temperature sensors 1 in order to reduce facility cost while obtaining the usefulness of temperature information. This is because, in the case of the plurality of directional temperature sensors 1, the directional temperature sensors 1 are only required to have the same temperature detection performance to derive the highest temperature direction information, and such performance of the directional temperature sensors 1 can be realized using low-performance temperature sensors, although the control temperature sensor 6 is required to have more precise temperature detection performance for more accurate determination of the surrounding situation.

That is, the control temperature sensor 6 is implemented as a temperature sensor, the performance of which is different from the performance of the directional temperature sensors 1. The control temperature sensor 6 is implemented as a temperature sensor having a higher level of performance than the directional temperature sensors 1. Accordingly, the automatically activated intelligent fire extinguisher 100 according to an embodiment of the present invention can advantageously have maximum fire-detecting and extinguishing effects without requiring costs greater than necessary for the fabrication thereof.

For example, the control temperature sensor 6 may be implemented as one of, but not limited to, a thermocouple temperature sensor, a resistance temperature detector (RTD) temperature sensor, a thermistor temperature sensor, an integrated circuit (IC) temperature sensor, a magnetic temperature sensor, a thermopile temperature sensor, and a pyroelectric temperature sensor.

The alarm 7 is configured to generate and deliver a warning signal. That is, the alarm 3 generates an audio signal (e.g. warning sound), a visible signal (e.g. warning light), a vibration signal, an electrical signal, or the like when a signal is received or power is supplied under the control of the operation controller 8. The alarm 7 may generate different types of warning signals depending on the type of an additional alarm sensor connected to an additional alarm sensor connector 14.

The operation controller 8 is configured to control the operation, i.e. on/off operation, of each of the alarm 7, the direction controller 5, and the fire-extinguishing agent valve 4. That is, the operation controller 8 may control a supply voltage to be supplied to at least one among the alarm 7, the direction controller 5, and the fire-extinguishing agent valve 4, depending on information regarding detected temperatures. Here, when the direction controller 5 is activated, the directional temperature sensors 1 and the rotary motor 2 may also be activated under the control of the direction controller 5.

In particular, the operation controller 8 may divide the temperature information detected by the control temperature sensor 6 into a plurality of temperature ranges, and perform the control operation according to the corresponding temperature ranges. That is, the operation controller 8 may control the power saving function, the alarm function, the fire-extinguishing preparation function, or the fire-extinguishing activation function to be performed, according to the temperature range detected by the control temperature sensor 6.

For example, the operation controller 8 may divide the temperature information detected by the control temperature sensor 6 into first to third ranges in the order of low to high temperature, and perform the control operation according to the corresponding range. That is, the first range is an ordinary time period in which no fire has occurred. For example, the first range may correspond to a temperature range lower than 50° C. The second range is a time period in which the probability of fire occurrence is high. The second range may correspond to a temperature range higher than the first range, for example, a temperature range from 50° C. to 80° C. The third range is a time period in which a fire has occurred. The third range may correspond to a temperature range higher than the second range, for example, a temperature range higher than 80° C.

When the temperature information detected by the control temperature sensor 6 is in the first range, the operation controller 8 may perform the control operation such that none of the alarm 7, the direction controller 5, and the fire-extinguishing agent valve 4 is activated, so that the power saving function is performed. That is, in this case, the automatically activated intelligent fire extinguisher according to an embodiment of the present invention may save power by stopping the supply of power to the alarm 7, the direction controller 5, and the fire-extinguishing agent valve 4.

When the temperature information detected by the control temperature sensor 6 is in the second range, the operation controller 8 may perform the control operation to activate (for example, to supply power to) the alarm 7, so that an alarm function is performed. That is, in this case, the automatically activated intelligent fire extinguisher according to an embodiment of the present invention can generate a warning signal, so that people can take quick actions.

In addition, the temperature information detected by the control temperature sensor 6 is in the second range, the operation controller 8 may perform the control operation to only activate (for example, to supply power only to) the direction controller 5, so that the fire-extinguishing preparation function is performed. That is, in this case, since the automatically activated intelligent fire extinguisher according to an embodiment of the present invention activates the direction controller 5, there is an advantage in that the fire-extinguishing agent can be immediately discharged in the highest temperature direction when the temperature information detected later by the control temperature sensor 6 reaches the third range. That is, during the second range, the directional temperature sensors 1 and the rotary motor 2 are activated under the control of the direction controller 5. Consequently, the fire-extinguishing agent nozzle 3 is set to be oriented in the highest temperature direction.

In addition, when the temperature information detected by the control temperature sensor 6 is in the second range, the operation controller 8 may perform the control operation to activate both the direction controller 5 and the alarm 7, so that the alarm function and the fire-extinguishing preparation function are performed.

When the temperature information detected by the control temperature sensor 6 is in the third range, the operation controller 8 may perform the control operation to activate the direction controller 5 and the fire-extinguishing agent valve 4, so that the fire-extinguishing activation function (e.g. a fire-directed fire-extinguishing operation and a fire-extinguishing operation based on tracking of a fire propagation direction) is performed. That is, in this case, the automatically activated intelligent fire extinguisher according to an embodiment of the present invention can discharge the fire-extinguishing agent in the highest temperature direction. Consequently, the fire-extinguishing agent valve 4 is activated to be opened, and the directional temperature sensors 1 and the rotary motor 2 are activated under the control of the operation controller 8. Here, the operation controller 8 may perform the control operation not to activate the alarm 7 in order to reduce the amount of power consumed. In addition, when the temperature information returns to the first range since the fire is extinguished, the operation controller 8 controls the fire-extinguishing agent valve 4 and the direction controller to stop operations. Consequently, the discharge of the fire-extinguishing agent is stopped.

As described above, when the control temperature sensor 6, the alarm 7, and the operation controller 8 are further included, the automatically activated intelligent fire extinguisher 100 according to an embodiment of the present invention can generate a warning signal at a time in which the probability of fire occurrence is high, so that people can take quick actions. In addition, since the operation controller 8 divides the temperature information detected by the control temperature sensor 6 into a plurality of ranges and performs the control operation according to the corresponding range, the automatically activated intelligent fire extinguisher 100 according to an embodiment of the present invention achieves effects in that the circuit can be prevented from deteriorating and the consumption of power, such as battery power, can be reduced.

Figure 5:
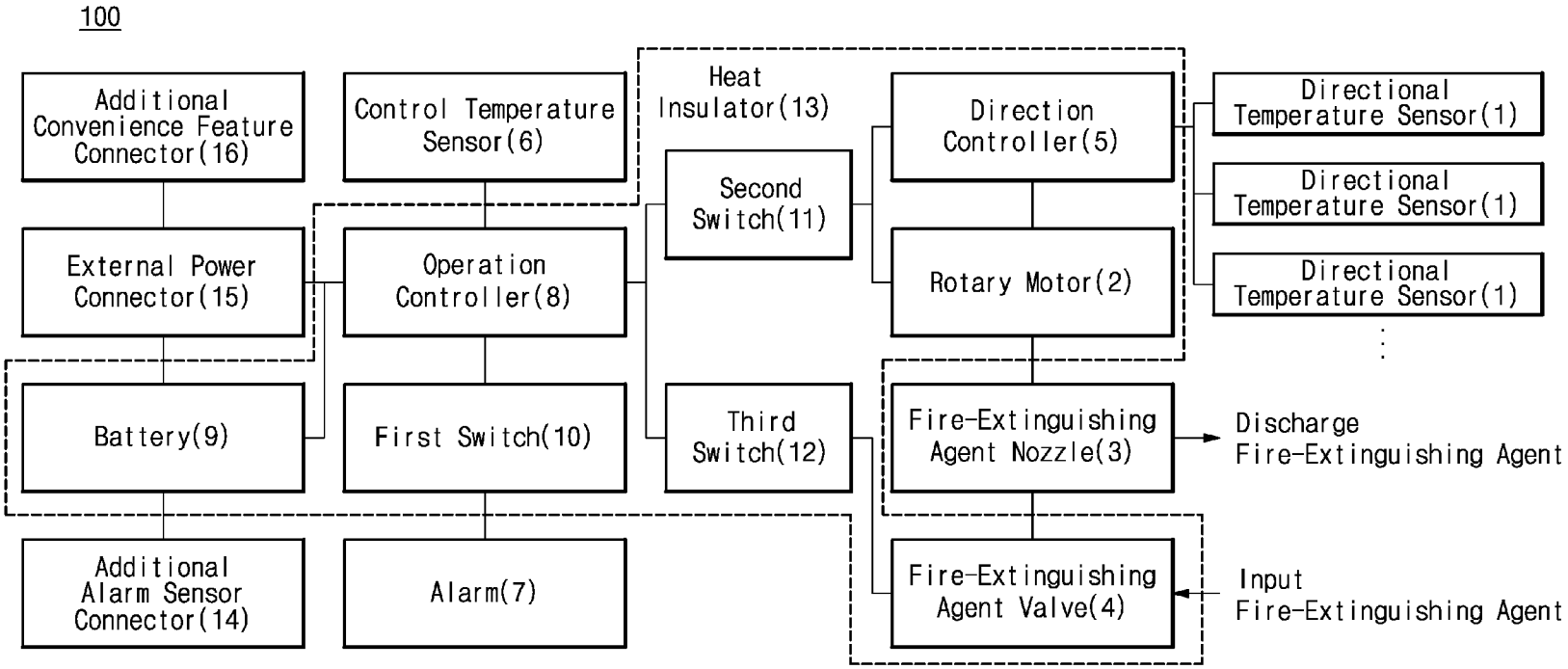
FIG. 5 is a configuration block diagram illustrating the automatically activated intelligent fire extinguisher 100 according to an embodiment of the present invention further including a battery 9, a first switch 10, a second switch 11, and a third switch 12.

FIG. 5 is a configuration block diagram illustrating the automatically activated intelligent fire extinguisher 100 according to an embodiment of the present invention further including a battery 9, a first switch 10, a second switch 11, and a third switch 12.

As illustrated in FIG. 5, the automatically activated intelligent fire extinguisher 100 according to an embodiment of the present invention may further include the battery 9, the first switch 10, the second switch 11, and the third switch 12.

The battery 9 is configured to supply power to electric devices (e.g. the operation controller, the rotary motor, the fire-extinguishing agent valve, the alarm, and the like) of the automatically activated intelligent fire extinguisher 100 according to an embodiment of the present invention. The battery 9 may be implemented as a built-in replaceable battery or a rechargeable battery including a charging module.

The first switch 10 is configured to switch connection of power supplied to the alarm 7 by the battery 9. The second switch 11 is configured to switch connection of power supplied to the direction controller 5 and the rotary motor 2 by the battery 9. The third switch 12 is configured to switch connection of power supplied to the fire-extinguishing agent valve 4 by the battery 9. Here, the first switch 10, the second switch 11, and the third switch 12 are turned on or off by a control signal from the operation controller 8.

The operation controller 8 controls the on/off operation of the first switch 10, the second switch 11, and the third switch 12 depending on the temperature information detected by the control temperature sensor 6, thereby controls the operation of each of the alarm 7, the direction controller 5, and the fire-extinguishing agent valve 4. That is, when the first switch 10 is turned on under the control of the operation controller 8, the alarm 7 generates a warning signal using power supplied by the battery 9. In addition, when the second switch 11 is turned on under the control of the operation controller 8, the direction controller 5 and the rotary motor 2 activate the control operation of the direction controller 5 using power supplied by the battery 9. In addition, when the third switch 12 is turned on under the control of the operation controller 8, the fire-extinguishing agent valve 4 opens the valve using power supplied by the battery 9.

For example, the operation controller 8 may divide the temperature information detected by the control temperature sensor 6 into first to third ranges in the order of low to high temperature, and perform the control operation according to the corresponding range.

That is, when the temperature information detected by the control temperature sensor 6 is in the first range (e.g. a temperature range lower than 50° C.), the operation controller 8 may perform the control operation to turn off the first switch 10, the second switch 11, and the third switch 12, so that the power saving function is performed. Consequently, none of the alarm 7, the direction controller 5, and the fire-extinguishing agent valve 4 is activated.

When the temperature information detected by the control temperature sensor 6 is in the second range (e.g. a temperature range from 50° C. to 80° C.), the operation controller 8 may perform the control operation to turn the first switch 10 on, so that the alarm function is performed. Consequently, the alarm 7 is activated.

In addition, When the temperature information detected by the control temperature sensor 6 is in the second range (e.g. a temperature range from 50° C. to 80° C.), the operation controller 8 may perform the control operation to turn the second switch 11 on, so that the fire-extinguishing preparation function is performed. Consequently, the fire-extinguishing agent nozzle 3 is previously controlled to be oriented in the highest temperature direction, in response to the operation of the direction controller 5.

In addition, when the temperature information detected by the control temperature sensor 6 is in the second range (e.g. a temperature range from 50° C. to 80° C.), the operation controller 8 may perform the control operation to turn the first switch 10 and the second switch 11 on, so that both the alarm function and the fire-extinguishing preparation function are performed. Consequently, the alarm 7 is activated, and the fire-extinguishing agent nozzle 3 is previously controlled to be oriented in the highest temperature direction, in response to the operation of the direction controller 5.

When the temperature information detected by the control temperature sensor 6 is in the third range (e.g. a temperature range higher than 80° C.), the operation controller 8 may perform the control operation to turn the second switch 11 and the third switch 12 on, so that the fire-extinguishing activation function is performed. Consequently, the fire-extinguishing agent valve 4 is opened, the fire-extinguishing agent is discharged in the previously-set highest temperature direction, and the control function of the operation controller 8 over the highest temperature direction remains operative until the fire is extinguished, i.e. the temperature information detected by the control temperature sensor 6 reaches the first range. Here, the operation controller 8 may control the first switch 10 to be turned off, so that the alarm 7 is not activated.

In addition, as illustrated in FIGS. 2, 3, and 5, the automatically activated intelligent fire extinguisher 100 according to an embodiment of the present invention further includes a heat insulator 13. Here, the heat insulator 13 may be implemented as an insulating member (e.g. an insulating member made of silica and alumina) having superior insulation performance for extremely-high temperatures in order to protect an internal circuit and internal components for at least a predetermined time in an extremely-high temperature. In particular, the rotary motor 2, the fire-extinguishing agent valve 4, the direction controller 5, the operation controller 8, the battery 9, the first switch 10, the second switch 11, and the third switch 12 may preferably be housed in and protected by the heat insulator 13, since they are components essentially required for performance of the fire-extinguishing activation function. Accordingly, the automatically activated intelligent fire extinguisher 100 according to an embodiment of the present invention can advantageously increase a length of time during which the fire-extinguishing activation function is performed even in a high-temperature environment in a fire.

In addition, as illustrated in FIG. 5, the automatically activated intelligent fire extinguisher 100 according to an embodiment of the present invention may further include the additional alarm sensor connector 14 to which an additional alarm sensor may be connected. That is, a variety of sensor modules, such as a smoke sensor, a gas sensor, and a flame sensor, may be changeably mounted on the additional alarm sensor connector 14 depending on the characteristic of a place in which the automatically activated intelligent fire extinguisher 100 according to an embodiment of the present invention is disposed. Here, the additional alarm sensor connector 14 may be supplied with power by the battery 9 or an external power connector 15, which will be described later.

The smoke sensor is a sensor detecting smoke produced in a fire. For example, the smoke sensor may be implemented as one of, but not limited to, a photosensitive smoke sensor, a light-scattering smoke sensor, and an ionization smoke sensor.

The gas sensor is a sensor detecting gas, such as liquefied natural gas (LNG), liquefied petroleum gas (LPG), carbon monoxide. For example, the gas sensor may be implemented as one of, but not limited to, a potentiostatic electrolytic gas sensor, an infrared (IR) absorption gas sensor, an optical interference gas sensor, a contact combustion gas sensor, a semiconductor gas sensor, and a gas chromatography gas sensor.

When the additional alarm sensor is connected to the additional alarm sensor connector 14, the automatically activated intelligent fire extinguisher 100 according to an embodiment of the present invention can more effectively perform life-saving and property protection functions. In particular, the alarm 7 may generate different types of warning signals depending on the type of the additional alarm sensor connected to the additional alarm sensor connector 14. Here, the alarm 7 may generate a warning signal by itself depending on the information detected by the additional alarm sensor regardless of the control of the operation controller 8.

As illustrated in FIG. 5, the automatically activated intelligent fire extinguisher 100 according to an embodiment of the present invention may further include the external power connector 15 to which external power (alternating current (AC) or direct current (DC)) is connectable and an additional convenience feature connector 16 to which an additional convenience feature is connectable. A variety of additional convenience features, such as a humidity sensor, a human body sensor, a communications module, and a closed circuit television (CCTV) module, may be detachably mounted to the additional convenience feature connector 16. The additional convenience feature connector 16 may receive power supplied by the battery 9 or via the external power connector 15. A fire-extinguishing facility may be compulsory under laws and regulations. In this case, since external power lines and communication lines are pre-installed, when an intended one of additional convenience modules is selectively connected to the additional convenience feature connector 16 to be used using the external power lines and the communication lines, the automatically activated intelligent fire extinguisher 100 according to an embodiment of the present invention can be used for purposes other than a fire-extinguishing purpose at ordinary times, which is economically advantageous. For example, the automatically activated intelligent fire extinguisher 100 according to an embodiment of the present invention may monitor temperature and humidity, as well as intruders, generate a notification on an abnormal situation, and work in concert with another automatically activated intelligent fire extinguisher, depending on the characteristic of a place in which the fire extinguisher is disposed.

When an external power source and the battery 9 are used, the external power source is used during ordinary times, and the battery 9 provided within the fire extinguisher is used in the event of power failure or fire, so that the automatically activated intelligent fire extinguisher 100 according to an embodiment of the present invention can minimize the amount of use of the battery 9. In addition, even in the case in which the battery 9 is only used without the external power source, power is only used by the operation controller 8, with the first switch 10, the second switch 11, and the third switch 12 being turned off, during ordinary times. Accordingly, the automatically activated intelligent fire extinguisher 100 according to an embodiment of the present invention can minimize the amount of power of the battery consumed.

Figure 6:
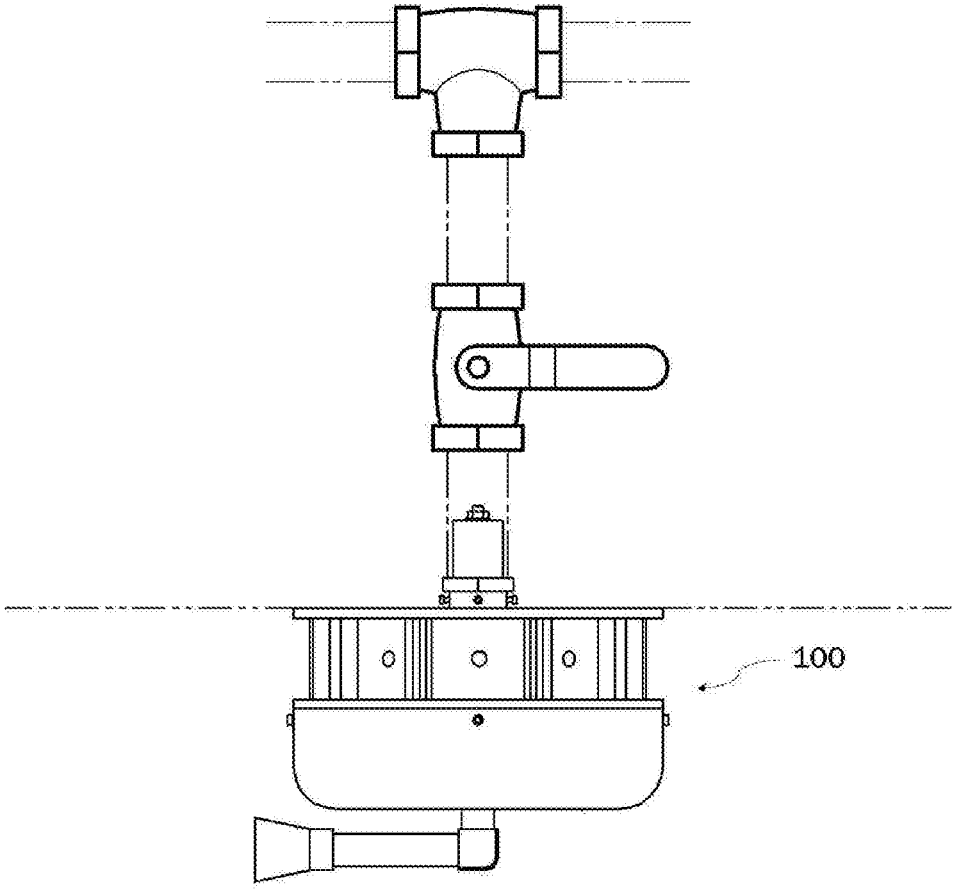
FIG. 6 illustrates the automatically activated intelligent fire extinguisher 100 according to an embodiment of the present invention connected to a hydrant device.

In addition, FIG. 6 illustrates the automatically activated intelligent fire extinguisher 100 according to an embodiment of the present invention connected to a hydrant device through which pressurized fire-fighting water flows.

Figure 7:
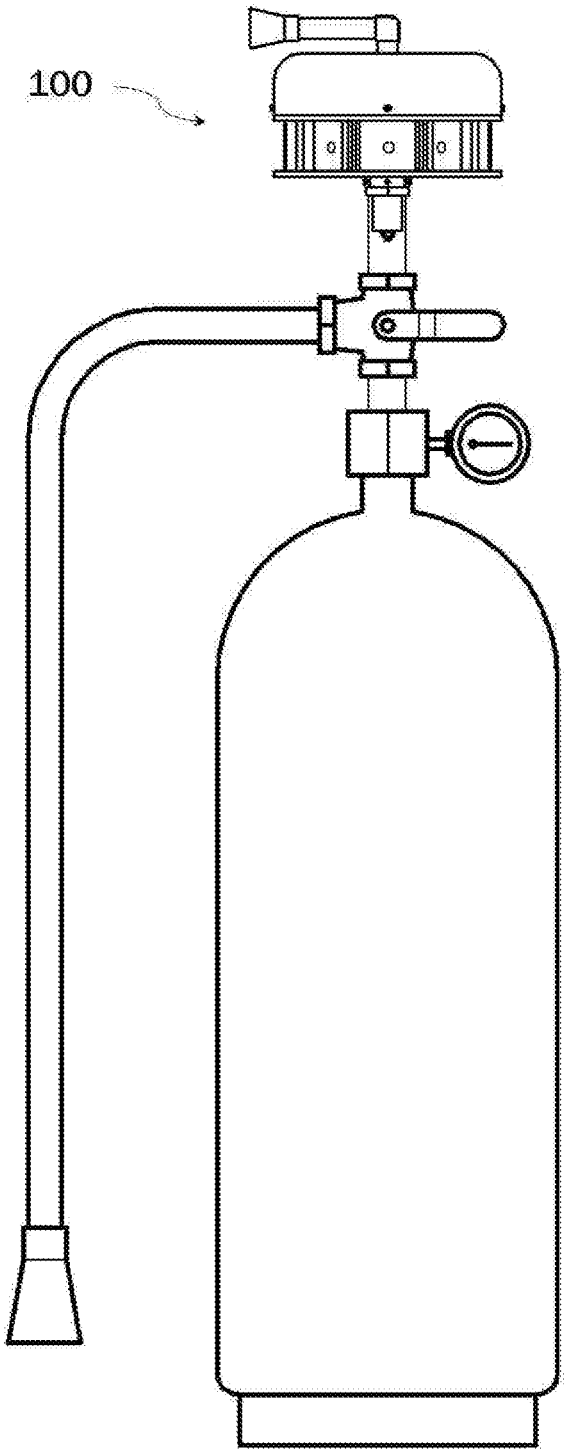
FIG. 7 illustrates the automatically activated intelligent fire extinguisher 100 according to an embodiment of the present invention connected to a fire extinguisher tank in which a fire-extinguishing agent is contained.

Furthermore, FIG. 7 illustrates the automatically activated intelligent fire extinguisher 100 according to an embodiment of the present invention connected to a fire extinguisher tank in which a fire-extinguishing agent is contained. In this case, the automatically activated intelligent fire extinguisher 100 according to an embodiment of the present invention can be frequently relocated by a fire-extinguishing system designer, due to excellent portability and mobility thereof. That is, when fire-fighting instruments are rearranged in a specific space, the fire extinguisher tank, to which the automatically activated intelligent fire extinguisher 100 is mounted, can also be relocated so as to be prepared for a fire.

While the present invention has been described with reference to the certain embodiments shown in the drawings, these embodiments are illustrative only. Rather, it will be understood by those skilled in the art that various modifications and equivalent other embodiments may be made therefrom. Therefore, the true scope of the present disclosure shall be defined by the concept of the appended claims.

INDUSTRIAL APPLICABILITY

The present invention relates to an automatically activated intelligent fire extinguisher that can automatically discharge a fire-extinguishing agent in the direction of a fire and discharge the fire-extinguishing agent while rotating by tracking the propagation direction of the fire, thereby more efficiently extinguishing the fire. Accordingly, the present invention has industrial applicability.

The invention claimed is:

1. An automatically activated intelligent fire extinguisher comprising:

a plurality of directional temperature sensors provided to detect temperatures in a plurality of directions;

a rotary motor providing torque;

a fire-extinguishing agent nozzle configured to be rotated by the torque of the rotary motor, a fire-extinguishing agent valve communicating with the fire-extinguishing agent nozzle to adjust a fire-extinguishing agent input to the fire-extinguishing agent nozzle;

a direction controller controlling rotation of the rotary motor on the basis of information regarding the temperatures in the plurality of directions detected by the plurality of directional temperature sensors;

a control temperature sensor detecting a surrounding temperature;

an alarm generating a warning signal; and an operation controller performing a control operation by dividing the information regarding the surrounding temperature detected by the control temperature sensor into a plurality of ranges, wherein the operation controller controls operations of the alarm, the direction controller, and the fire-extinguishing agent valve to be off when the information regarding the surrounding temperature detected by the control temperature sensor is in a first range, the operation controller controls the operation of the alarm to be on when the information regarding the surrounding temperature detected by the control temperature sensor is in a second range higher than the first range, and the operation controller controls the operations of the direction controller and the fire-extinguishing agent valve to be on when the information regarding the surrounding temperature detected by the control temperature sensor is in a third range higher than the second range.

2. The automatically activated intelligent fire extinguisher according to claim 1, wherein the direction controller derives a highest temperature direction by comparing information regarding the temperatures in the plurality of directions detected by the directional temperature sensors for every predetermined time, and controls rotation of the rotary motor so that the fire-extinguishing agent nozzle is oriented in the derived highest temperature direction.

3. The automatically activated intelligent fire extinguisher according to claim 1, wherein the control temperature sensor has at least one characteristic among a wider detection temperature range, a higher response rate, a lower error range, and higher detection accuracy, compared to the directional temperature sensors.

4. The automatically activated intelligent fire extinguisher according to claim 1, wherein the fire-extinguishing agent nozzle is configured to be replaceable depending on a discharge angle or a type of the fire-extinguishing agent.

5. The automatically activated intelligent fire extinguisher according to claim 1, wherein the operation controller controls the operation of the direction controller, as well as the operation of the alarm, to be information regarding the surrounding temperature detected by the control temperature sensor is in the second range.

6. The automatically activated intelligent fire extinguisher according to claim 1, further comprising:

a battery supplying power;

a first switch switching connection of the power of the battery supplied to the alarm;

a second switch switching connection of the power of the battery supplied to the plurality of directional temperature sensors, the rotary motor, and the direction controller; and a third switch switching connection of the power of the battery supplied to the fire-extinguishing agent valve, wherein the operation controller on/off controls the first switch, the second switch, and the third switch depending on the information regarding the surrounding temperature detected by the control temperature sensor.

7. The automatically activated intelligent fire extinguisher according to claim 5, further comprising a heat insulator housing the rotary motor, the fire-extinguishing agent valve, the direction controller, the operation controller, and a battery supplying power, the heat insulator comprising an insulating member.

8. The automatically activated intelligent fire extinguisher according to claim 5, further comprising:

an additional alarm sensor connector connectable to an additional alarm sensor, an external power connector connectable to an external power source; and an additional convenience feature connector connectable to an additional convenience feature except for a fire-extinguishing purpose.

9. The automatically activated intelligent fire extinguisher according to claim 8, wherein the alarm generates different types of warning signals depending on types of the additional alarm sensor connected to the additional alarm sensor connector.

10. An automatically activated intelligent fire extinguisher comprising:

a plurality of directional temperature sensors provided to detect temperatures in a plurality of directions, a rotary motor providing torque, a fire-extinguishing agent nozzle configured to be rotated by the torque of the rotary motor, a fire-extinguishing agent valve communicating with the fire-extinguishing agent nozzle to adjust a fire-extinguishing agent input to the fire-extinguishing agent nozzle, a direction controller controlling rotation of the rotary motor on the basis of information regarding the temperatures in the plurality of directions detected by the plurality of directional temperature sensors, a control temperature sensor detecting a temperature, an alarm generating a warning signal, and an operation controller controlling an operation of at least one of the alarm, the direction controller, and the fire-extinguishing agent valve depending on information regarding the temperature detected by the control temperature sensor, wherein the operation controller performs a control operation by dividing the information regarding the temperature detected by the control temperature sensor into a plurality of ranges, the operation controller controls operations of the alarm, the direction controller, and the fire-extinguishing agent valve to be off when the information regarding the temperature detected by the control temperature sensor is in a first range, the operation controller controls the operation of the alarm to be on when the information regarding the temperature detected by the control temperature sensor is in a second range higher than the first range, and the operation controller controls the operations of the direction controller and the fire-extinguishing agent valve to be on when the information regarding the temperature detected by the control temperature sensor is in a third range higher than the second range.

11. The automatically activated intelligent fire extinguisher according to claim 10, wherein the fire-extinguishing agent nozzle is configured to be replaceable depending on a discharge angle or a type of the fire-extinguishing agent, and to have a different discharge angle depending on the type of the fire-extinguishing agent.

* * * * *